United States Patent [19]

Powell, deceased et al.

[11] Patent Number: 4,923,702

[45] Date of Patent: May 8, 1990

[54] COMMUNION CONTAINER

[76] Inventors: Levisky Powell, deceased, late of Memphis, Tenn.; by Bettye J. Powell, aministratrix, 4534 Whitepine St., Memphis, Tenn. 38109; Johnese W. Powell, 4911 Whitworth Rd., Memphis, Tenn. 38116

[21] Appl. No.: 241,408

[22] Filed: Sep. 7, 1988

Related U.S. Application Data

[63] Continuation-in-part of Ser. No. 75,650, Jul. 20, 1987, abandoned.

[51] Int. Cl.[5] ..... B65D 81/32; B65D 25/08

[52] U.S. Cl. ..... 426/115; 426/120; 426/122; 426/123; 426/124; 206/217; 206/19; 220/23; 220/23.83

[58] Field of Search ..... 426/86, 120, 115, 124, 426/122, 123; 206/217, 216, 501, 503, 218, 219, 19; 220/23, 256, 257, 258, 269, 90.6

[56] References Cited

U.S. PATENT DOCUMENTS

| | | | |
|---|---|---|---|
| 1,547,903 | 7/1925 | Cole | 229/120.32 |
| 1,754,524 | 4/1930 | Porter | 206/215 |
| 1,760,761 | 5/1930 | March | 426/120 |
| 1,798,339 | 3/1931 | Soulis | 426/86 |
| 2,076,132 | 4/1937 | Le Rose | 426/120 |
| 2,287,610 | 6/1942 | Guidry | 229/120.32 |
| 2,604,976 | 7/1952 | Sarg | 220/23 |
| 2,766,796 | 10/1956 | Tupper | 426/120 |
| 2,863,778 | 12/1958 | Lynn | 426/120 |
| 2,965,496 | 12/1960 | Serdar | 426/120 |
| 2,979,193 | 4/1961 | Fredette | 220/23.83 |
| 3,103,224 | 9/1963 | Dearling | 220/23 |
| 3,167,237 | 1/1965 | Negus et al. | 206/615 |
| 3,310,195 | 3/1967 | Wagner et al. | 220/23.83 |
| 3,385,503 | 5/1968 | Stump | 426/120 |
| 3,417,895 | 12/1968 | Pewton | 220/23.83 |
| 3,419,181 | 12/1968 | Stec | 220/258 |
| 3,514,029 | 5/1970 | Powell | 426/123 |
| 3,561,668 | 2/1971 | Bergstrom | 220/258 |
| 3,662,913 | 5/1972 | Mascia | 220/23 |
| 3,746,158 | 7/1973 | Cownick | 426/120 |
| 3,915,296 | 10/1975 | Spencer | 426/86 |
| 3,920,120 | 11/1975 | Shveda | 426/86 |
| 4,033,453 | 7/1977 | Giaimo | 426/86 |
| 4,074,827 | 2/1978 | Labe | 426/120 |
| 4,324,338 | 4/1982 | Beall | 206/217 |
| 4,416,370 | 11/1983 | Beall | 206/217 |
| 4,453,646 | 6/1984 | Harrild | 220/258 |
| 4,485,923 | 12/1984 | Schwalkert | 206/503 |
| 4,684,015 | 8/1987 | Vezirian | 220/20 |
| 4,694,960 | 9/1987 | Phipps | 206/615 |
| 4,703,849 | 11/1987 | Vezirian et al. | 206/217 |
| 4,773,541 | 9/1988 | Riddell | 206/615 |

FOREIGN PATENT DOCUMENTS

| | | | |
|---|---|---|---|
| 796428 | 10/1935 | France | 426/120 |
| 6615638 | 5/1967 | Netherlands | 220/256 |

*Primary Examiner*—Steven Weinstein
*Attorney, Agent, or Firm*—Walker & McKenzie

[57] ABSTRACT

An improved communion container for containing a portion of wine/grape juice and a portion of bread. The container includes a cup containing the portion of wine/grape juice, the cup having an open mouth; a lid for being secured to the cup about the open mouth to close the open mouth and to seal the portion of wine/-grape juice within the cup, the lid having a tab portion for allowing easy manual removal of the lid from the cup; a receptacle containing the portion of bread, the receptacle having a cavity for containing the portion of bread and including structure for closing the cavity to seal the portion of bread within the cavity; and attachment structure for attaching the receptacle to the cup after the portion of wine/grape juice is sealed within the cup and after the portion of bread is sealed within the cavity of the receptacle and with the tab portion of the lid positioned beneath a portion of the receptacle to prevent inadvertent removal of the lid until the receptacle is opened.

3 Claims, 3 Drawing Sheets

COMMUNION CONTAINER

REFERENCE TO RELATED APPLICATION

This is a continuation-in-part of application Ser. No. 07/075,650, filed July 20, 1987, now abandoned, entitled "Improved Communion Container and Method of Construction."

BACKGROUND OF THE INVENTION

1. Field of the Invention

The present invention relates in general to communion containers and more specifically to an improved compartmental communion container which is prefilled with portions of both unleavened bread and wine/grape juice.

2. Information Disclosure Statement

Soulis, U.S. Pat. No. 1,798,339, discloses a paper cup having a recessed bottom for holding a container in which a tablet, powder or the like is enclosed. The top of the Soulis paper cup is open to allow a plurality of the cups to nest within one another. Sarge, U.S. Pat. No. 2,604,976, discloses a combined liquid and food lunch container. The container of the Sarge combination consists of a cylinder for holding a doughnut or the like, the cylinder being closed at the top end by a transparent disc and closed at a point between the top and bottom ends by a bottom plate having a tab fitted into a groove provided on the inner face of the cylinder; and a cup for holding a quantity of liquid, the lower end of the cylinder fitting over the upper end of the cup with the bottom plate serving as a closure for the cup. Tupper, U.S. Pat. No. 2,766,796, discloses an open top cup or tumbler and a lid for closing the open top of the cup or tumbler, the lid having a receptable for holding sugar, medicine, etc. Serdar, U.S. Pat. No. 2,965,496, discloses a container having a can-like primary compartment and a secondary compartment mounted on the lid of the can-like primary compartment. Lynn, U.S. Pat. No. 2,863,778, discloses a can for holding food and the like, the can having a recessed top defined by an upstanding rim, and a relatively flat or thin packet for holding vitamins and the like, the packet being attached to the top of the can within the recess in a manner so that the packet can be removed from the can without rupturing and spillage of the contents. Dearling, U.S. Pat. No. 3,103,224, discloses a powder box including a primary box for holding a large quantity of powder, a cover for covering the top of the primary box and for defining a secondary box for containing a smaller quantity of powder, and a removable lid on the top of the primary box to allow powder to be moved from the primary box to the secondary box. Powell, U.S. Pat. No. 3,514,029, discloses a compartmental communion container having a cup element holding wine and a receptacle element holding bread and serving as a lid to seal the mouth of the cup. Mascia, U.S. Pat. No. 3,662,913, discloses an overcap for being attached to a prime container for forming a closed container for a second product; the overcap includes a cup-like body for being snapped onto the primer container, and a snap-in cover for closing the open end of the cup-like body. Connick, U.S. Pat. No. 3,746,158, discloses an overcap for releasable engagement with an end of a container for centrally spacing an auxiliary item therewithin. Spencer, U.S. Pat. No. 3,915,296, discloses a container having a quantity of solid material sealed from the interior of the container by a dissolvable member so that when liquid is added to the container, both the dissolvable member and the solid material will dissolve; a removable seal having a tab which clears the outer edge of the container may be provided to close an opening through which the liquid may be removed from the interior of the container. Shveda, U.S. Pat. No. 3,920,120, discloses an open top cup or the like for containing a primary product such as ice cream or the like and having a recessed bottom within which a secondary product such as a napkin or the like may be secured by an adhesive or the like. Giaimo, U.S. Pat. No. 4,033,453, discloses a drinking cup having a hollow or false bottom for containing a quantity of medicine or the like, the bottom being adapted to be broken to release the medicine or the like into the drinking cup for subsequent mixing with water, a drnking straw forming a part of the rupturable bottom of the cup. Labe, U.S. Pat. No. 4,074,827 discloses a multi-purpose closure for the mouth of a container, the closure having a cavity therein for containing or dispensing useful products or serving as an amusement device. Schwaikert, U.S. Pat. No.4,485,923, discloses a stackable container having a female member on the top end thereof for receiving the male member on the bottom end of an identical container stacked above it. The present invention is not disclosed or suggested by any of the above-identified patents.

SUMMARY OF THE INVENTION

The present invention is directed toward providing an improved communion container. The concept of the present invention is to provide a communion container that contains separately sealed portions of wine/grape juice and bread and that is constructed in a manner that allows easy access to the portion of bread while the portion of wine/grape juice is prevented from being inadvertently unsealed prior to the portion of bread being unsealed.

The improved communion container of the present invention contains a portion of wine/grape juice and a portion of bread. The container includes a cup containing the portion of wine/grape juice, the cup having an open mouth; a lid for being secured to the cup about the open mouth to close the open mouth and to seal the portion of wine/grape juice within the cup, the lid having a tab portion for allowing easy manual removal of the lid from the cup; a receptacle containing the portion of bread, the receptacle having a cavity for containing the portion of bread and including means for closing the cavity to seal the portion of bread within the cavity; and attachment means for attaching the receptacle to the cup after the portion of wine/grape juice is sealed within the cup and after the portion of bread is sealed within the cavity of the receptacle and with the tab portion of the lid positioned beneath a portion of the receptacle to prevent inadvertent removal of the lid until the receptacle is opened.

An objective of the present invention is to provide a communion container for containing both a portion of wine/grape juice and a portion of bread adapted to prevent inadvertent access to the wine/grape juice portion until after access has been made to the bread portion.

Another objective of the present invention is to provide a communion container for containing both a portion of wine/grape juice and a portion of bread which will prevent embarrassment due to inadvertent access to the wine/grape juice portion before access to the bread portion. The Christian communion ritual calls for partaking of the bread before partaking of the wine.

Another objective of the present invention is to provide a communion container for containing both a portion of wine/grape juice and a portion of bread which allows easier manipulation of the cup and lids thereof and to allow one hand to be unoccupied while going through the communion ritual of: (1) partially removing the bread lid, (2) accessing and eating the bread, and (3) removing the bread and wine lids to partake of the wine.

DESCRIPTION OF THE PREFERRED EMBODIMENT

Figure 1:
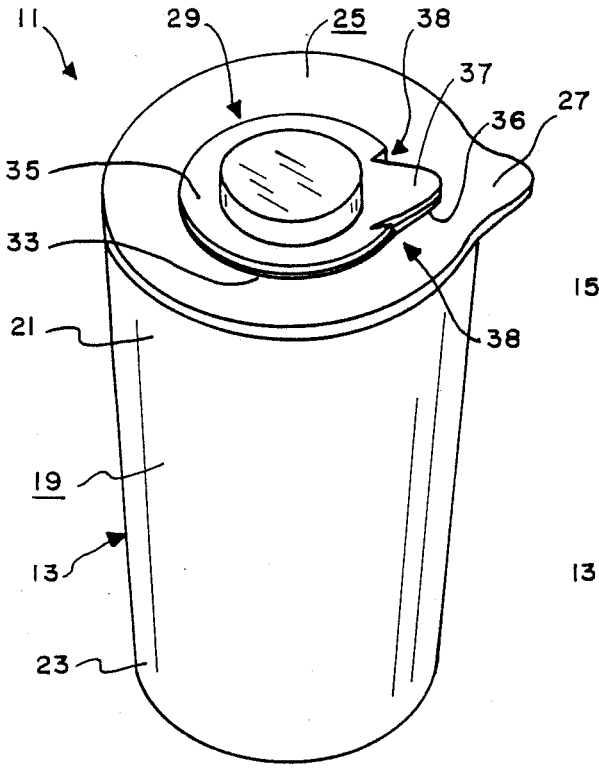
FIG. 1 is a perspective view of a first emodiment of the communion container of the present invention.

The communion container of the present invention is for use in religious communion services for containing a portion of liquid L (i.e., wine or grape juice) and a portion of bread B. Basically, the present invention provides a disposable container which is pre-filled with portions of both the bread B and liquid L for use during communion services.

A first embodiment of the container of the present invention is shown in FIGS. 1–5 and is identified by the numeral 11.

The container 11 includes a cup 13 for containing the portion of liquid L. The cup 13 has an open mouth 15 and, preferably, a recessed bottom 17. Preferably, the cup 13 is defined by a generally upstanding wall member 19 having an upper end 21 terminating at the open mouth 15 and having a lower end 23, and a bottom member 24 extending across the wall member 19 at a point above the lower end 23 thereof to coact with the lower end 23 to define the recessed bottom 17 and to close the bottom of the cup 13 as will now be apparent to those skilled in the art. The cup 13 may be various specific sizes and shapes which will now be apparent to those skilled in the art and is preferably constructed of a disposable, transparent material in any manner now apparent to those skilled in the art such as by being molded out of plastic or the like as will now be apparent to those skilled in the art.

The container 11 includes a lid 25 for being secured to the cup 13 about the open mouth 15 to close the open mouth 15 and to seal the portion of liquid L within the cup 13. The lid 25 may include a tab portion 27 for allowing easy manual removal of the lid 25 from the cup 13. The lid 25 may be various specific sizes and shapes to correspond with the open mouth 15 of the cup 13 as will now be apparent to those skilled in the art and is preferably constructed of a disposable material such as by being molded out of plastic or the like as will now be apparent to those skilled in the art. The lid 25 may be secured to the cup 13 in any manner now apparent to those skilled in the art such as by being glued (not shown) or heat-sealed to the rim of the cup 13 about the open mouth 15.

The container 11 includes a receptacle 29 for the portion of bread B. The receptacle 29 has a cavity 31 for containing the portion of bread B and includes means for closing the cavity 31 to seal the portion of bread B within the cavity 31. The receptacle 29 preferably includes a base member 33 and a cover member 35. The base member 33 and cover member 35 preferably have corresponding tab portions 36, 37, and perforations or slots 38 are preferably provided adjacent each tab portion 36, 37 for allowing the receptacle 29 to be easily opened in a manner and for reasons which will hereinafter become apparent. The base member 33 may be various specific sizes and shapes to correspond with the lid 25 for reasons which will hereinafter become apparent and is preferably constructed of a disposable material such as by being molded out of plastic or the like as will now be apparent to those skilled in the art. The cover member 35 is preferably attached to the base member 33 to form a bubble-like cavity 31 therebetween. The cover member 35 may be various specific sizes and shapes to correspond with the base member 33 and is preferably constructed of a disposable, transparent material such as by being molded out of plastic or the like as will now be apparent to those skilled in the art. The cover member 35 may be secured to the base member 33 in any manner now apparent to those skilled in the art such as by being glued (not shown) or heat sealed thereto as will now be apparent to those skilled in the art.

The container 11 includes attachment means for attaching the receptacle 29 to the cup 13, either directly or indirectly, after the portion of liquid L is sealed within the cup 13 and after the portion of bread B is sealed within the cavity 31 of the receptacle 29. More specifically, the attachment means of the container 11 preferably includes a quantity of glue 39 or other adhesive for attaching the receptable 29 to the lid 25 as will now be apparent to those skilled in the art.

Figure 3:
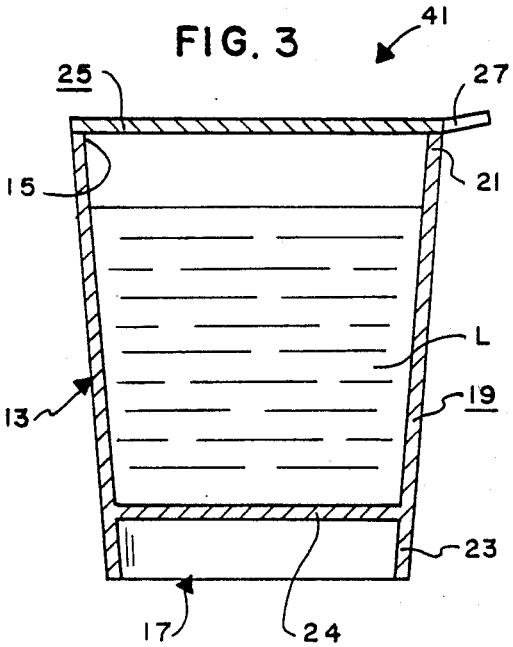
FIG. 3 is a sectional view of the sealed liquid-cup unit of the container of FIG. 1.
Figure 4:
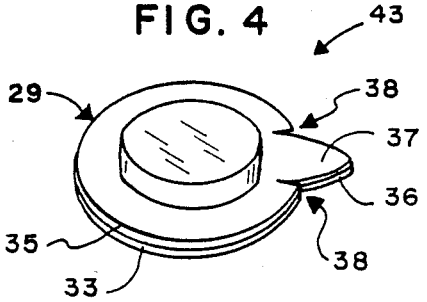
FIG. 4 is a perspective view of the sealed bread-receptacle unit of the container of FIG. 1.
Figure 5:
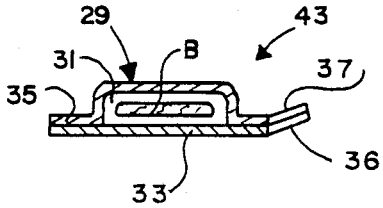
FIG. 5 is a sectional view of the sealed bread-receptacle unit of FIG. 4.

To produce the container 11, the cup 13 is filled with the portion of liquid L and the lid 25 is then secured to the cup 13 to seal the liquid L within the cup 13 and to form a sealed liquid/cup unit 41 as shown in FIG. 3; the cover member 35 is secured to the base member 33 with a portion of bread B provided therebetween to form a sealed bread/receptacle unit 43 as shown in FIGS. 4 and 5; and the sealed bread/receptacle unit 43 is attached to sealed liquid/cup unit 41 (i.e., to the lid 25) with the quantity of glue 39 or the like.

Figure 2:
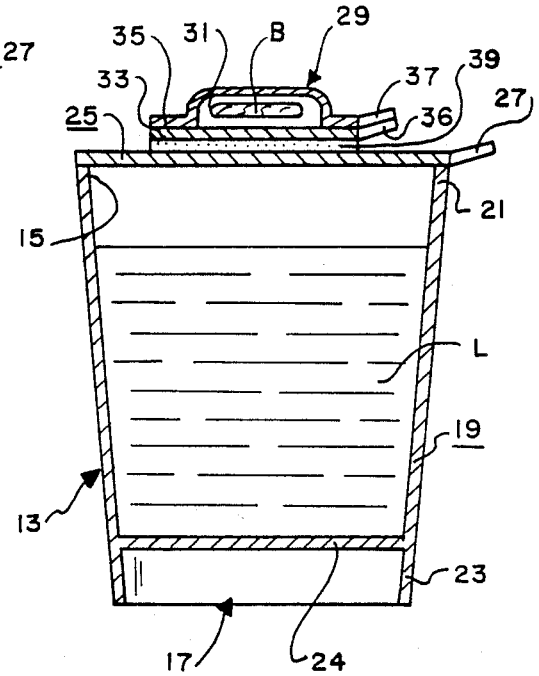
FIG. 2 is a sectional view of the container of FIG. 1.
Figure 12:
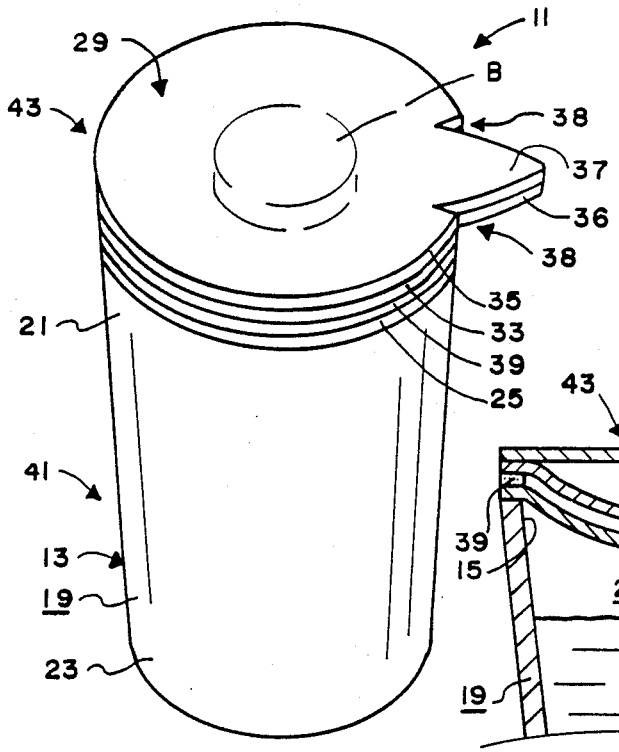
FIG. 12 is a perspective view of a container similar to the container of FIG. 1 but with the tab portion of the lid of the sealed liquid-cup unit positioned beneath a portion of the sealed bread-receptacle unit.
Figure 13:
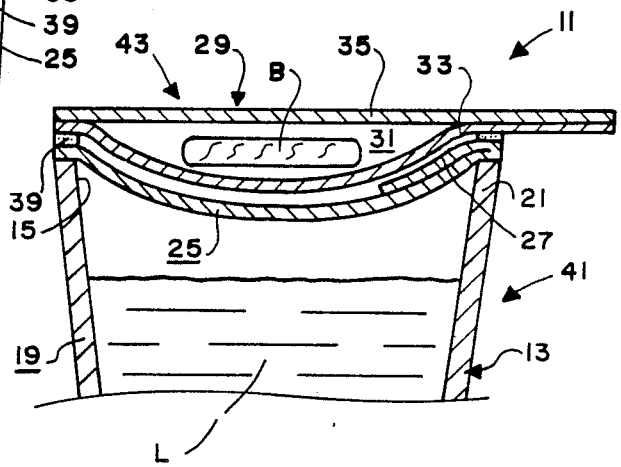
FIG. 13 is a sectional view of a portion of the container of FIG. 12.
Figure 14:
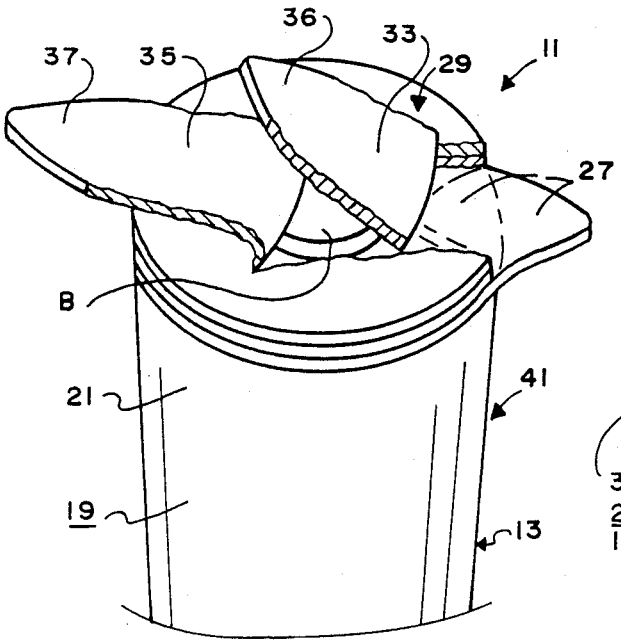
FIG. 14 is a somewhat diagrammatic perspective view of the container of FIG. 12 showing the bread-receptacle unit thereof being opened.

It should be noted that the sealed bread/receptacle unit 43 may be sized and shaped so as to substantially cover the lid 25 and the sealed bread/receptacle unit 43 may be attached to the lid 25 with the tab portion 27 of the lid 25 positioned beneath a portion of the sealed bread/receptacle unit 43 to prevent inadvertent removal of the lid 25 until removal of the cover member 35 of the receptacle 29 as will now be apparent to those skilled in the art as clearly shown in FIGS. 12–14. Thus, with the tab portion 27 of the lid 25 positioned beneath a portion of the sealed bread/receptacle unit 43, it will be extremely difficult if not impossible to inadvertently remove the lid 25 without first having opened the receptacle 29. As will be noted from FIG. 13, the lid 25 and base member 33 may be slightly concaved so that the cover member 35 can be substantially flat with the bread B positioned in the concavity as clearly shown in FIG. 13. Such a construction allows, among other things, a plurality of the container 11 to be stacked one on top of the other. The bottom of the container 11 shown in FIGS. 12–14 may or may not be recessed as shown in FIGS. 2 and 3. The operation of the container 11 of FIGS. 12–14 is diagrammatically shown in FIG. 14. More specifically, the first step in using the container 11 of FIGS. 12–14 is to manually pull the tabs 36, 37 upward. Due to the perforations 38 and the like, the base member 33 and cover member 35 will easily tear so as to allow access to the bread B as indicated in FIG. 14 and since the tab 27 is positioned beneath the base member 33, inadvertent removal of the lid 25 before the receptacle 29 is opened is prevented. Once the receptacle 29 has been thus opened, the tab 27 will be accessible and can be moved outward as shown in FIG. 14 where it can be manually pulled upward to remove the lid 25 from the cup 13.

Figure 15:
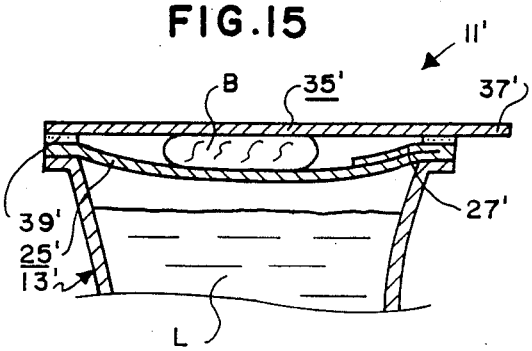
FIG. 15 is a sectional view of a modified embodiment of the container of FIG. 12.

A modified embodiment of the container 11 of FIGS. 12–14 is shown in FIG. 15 and is identified by the numeral 11'. The container 11' shown in FIG. 15 includes, in general, a cup 13' for containing the portion of liquid L, a lid 25' for being secured about the open mouth of the cup 13' to seal the portion of liquid L within the cup 13' and for receiving the portion of bread B, a cover 35' for being secured to the lid 25' and for covering the portion of bread B. The cover 35' has a tab portion 37' for allowing the cover 35' to be easily opened or removed, fully or partially, from the lid 25' to allow access to the portion of bread B as will now be apparent to those skilled in the art. The lid 25' also includes a tab portion 27' for allowing the lid 25' to be easily removed from the cup 13' to allow access to the portion of liquid L. The tab 27' is folded back upon the lid 25' and positioned beneath a portion of the cover 35' as clearly shown in FIG. 15 to prevent inadvertent removal or opening of the lid 25' until the cover 35' has been fully or partially opened or removed as will now be apparent to those skilled in the art. The lid 25' is preferbly slightly concaved so that the top of the cover 27' can be substantially flat with the portion of bread B positioned in the concavity as clearly shown in FIG. 15. The cup 13' may be molded out of plastic in any manner now apparent to those skilled in the art. The lid 25' may consist of a thin sheet of aluminum foil or the like cut to shape and glued or otherwise attached to the rim of the open mouth of the cup 13'. The cover 35' may consist of a thin sheet of clear plastic or the like secured by glue 39' or otherwise attached to the periphery of the lid 25' with the tab portion 27' folded back as shown in FIG. 15. To use the container 11' in a communion ritual, the tab portion 37' is first pulled to allow access to the portion of bread B. Next, the tab portion 27' is folded outward and then pulled upward to allow access to the portion of liquid L.

Figure 6:
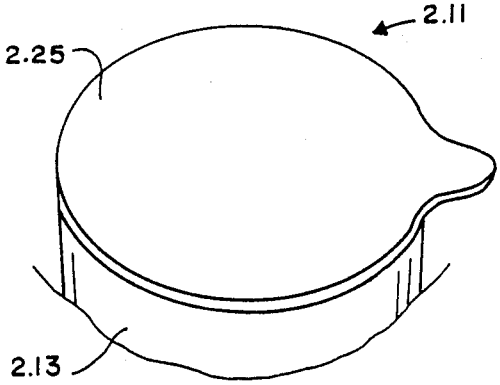
FIG. 6 is a perspective view of the upper portion of a second embodiment of the communion container of the present invention.
Figure 7:
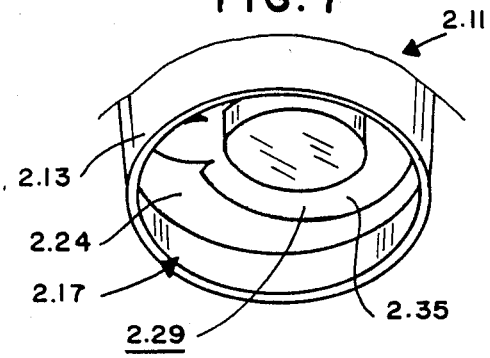
FIG. 7 is a perspective view of the lower portion of a second embodiment of the communion container of the present invention.
Figure 8:
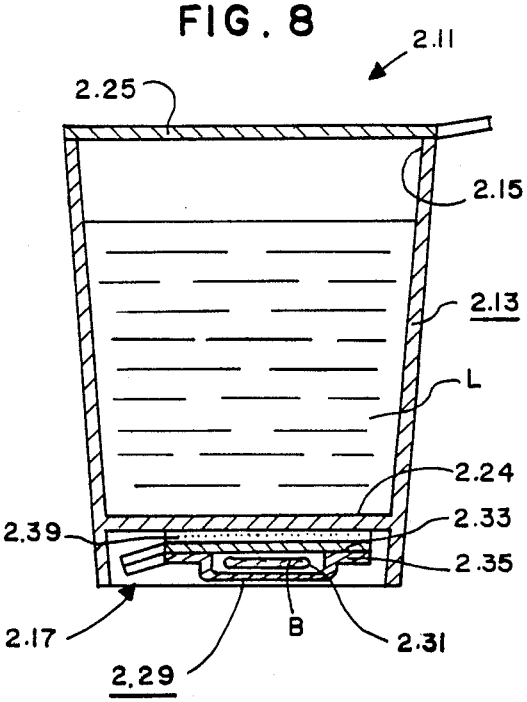
FIG. 8 is a sectional view of the container of FIG. 6.

A second embodiment of the container of the present invention is shown in FIGS. 6–8 and is identified by the numeral 2.11.

The container 2.11 includes a cup 2.13 for containing the portion of liquid L. The cup 2.13 is identical to the cup 13 described hereabove with reference to the container 11 and has, for example, an open mouth 2.15, a recessed bottom 2.17, and a bottom member 2.24. Reference to the above description of the cup 13 should be made for a full understanding of the structure, manufacture and use of the cup 2.13.

The container 2.11 includes a lid 2.25 for being secured to the cup 2.13 about the open mouth 2.15 to close the open mouth 2.15 and to seal the portion of liquid L within the cup 2.13. The lid 2.25 is identical to the lid 25 described hereabove with reference to the container 11, and reference to the above description of the lid 25 should be made for a full understanding of the structure, manufacture and use of the lid 25.

The container 2.11 includes a receptacle 2.29 for the portion of bread B. The receptacle 2.29 is preferably identical to the receptacle 29 described hereabove with reference to the container 11 and has, for example, cavity 2.31 for containing the portion of bread B, a base member 2.33 and a cover member 2.35. Reference to the above description of the receptacle 29 should be made for a full understanding of the structure and manufacture of the receptacle 2.29.

The container 2.11 includes attachment means for attaching the receptacle 2.29 to the cup 2.13, either directly or indirectly, after the portion of liquid L is sealed within the cup 2.13 and after the portion of bread B is sealed within the cavity 2.31 of the receptacle 2.29. The attachment means of the container 2.11 is preferably identical to the attachment means described hereabove with reference to the container 11 and includes, for example, a quantity of glue 2.39 or other adhesive for attaching the receptacle 2.29 to the cup 2.13, either directly or indirectly.

The major difference between the container 11 and the container 2.11 is that the receptacle 2.29 of the container 2.11 is mounted within the recess bottom 2.17 of the cup 2.13 rather than being attached to the lid 2.25. Thus, in the container 2.11, the glue 2.39 is positioned between the receptacle 2.29 and the bottom member 2.24 of the cup 2.13 rather than between the receptacle 2.29 and the lid 2.25.

To produce the container 2.11, the cup 2.13 is filled with the portion of liquid L and the lid 2.25 is then secured to the cup 2.13 to seal the liquid L within the cup 2.13 and to form a sealed liquid/cup unit identical to the sealed liquid/cup unit 41 of the container 11; the cover member 2.35 is secured to the base member 2.33 with a portion of bread B provided therebetween to form a sealed bread/receptacle unit identical to the sealed bread/receptacle unit 43 of the container 118; and the sealed bread/receptacle unit is attached to the bottom member 2.24 within the recessed bottom 2.17 of the cup 2.13 of the sealed liquid/cup unit with the quantity of glue 2.39 or the like.

Figure 9:
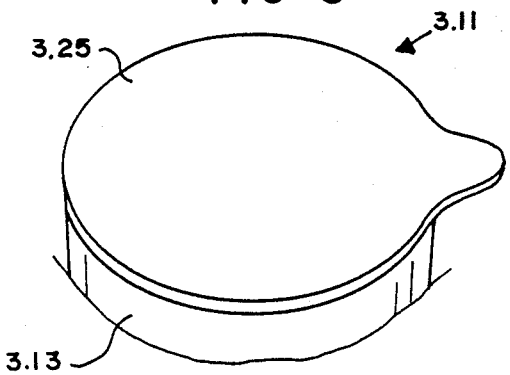
FIG. 9 is a perspective view of the upper portion of a third embodiment of the communion container of the present invention.
Figure 10:
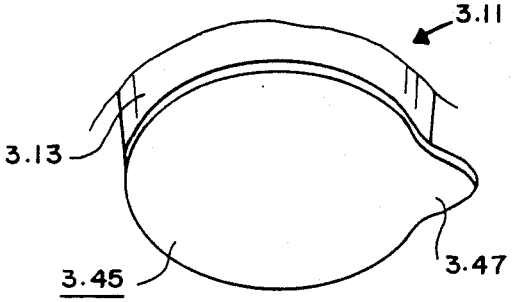
FIG. 10 is a perspective view of the lower portion of a third embodiment of the communion container of the present invention.
Figure 11:
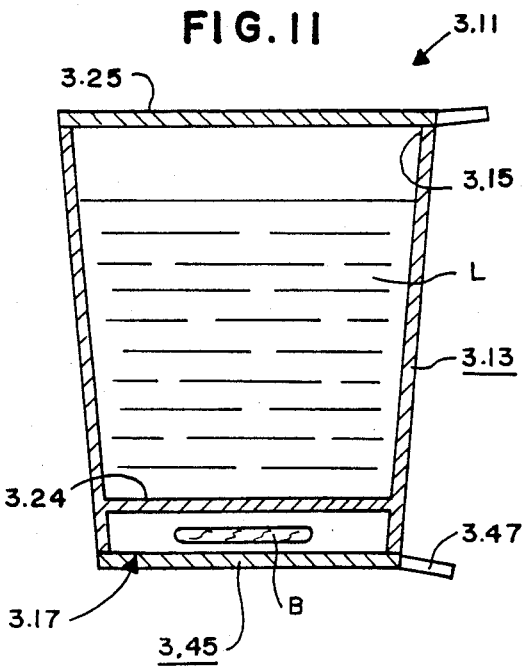
FIG. 11 is a sectional view of the container of FIG. 9.

A third embodiment of the container of the present invention is shown in FIGS. 9–11 and is identified by the numeral 3.11.

The container 3.11 includes a cup 3.13 for containing the portion of liquid L. The cup 3.13 is identical to the cup 13 described hereabove with reference to the container 11 and has, for example, an open mouth 3.15, a recessed bottom 3.17, and a bottom member 3.24. Reference to the above description of the cup 13 should be made for a full understanding of the structure, manufacture and use of the cup 3.13.

The container 3.11 includes a lid 3.25 for being secured to the cup 3.13 about the open mouth 3.15 to close the open mouth 3.15 and to seal the portion of liquid L within the cup 3.13. The lid 3.25 is identical to the lid 25 described hereabove with reference to the container 11, and reference to the above description of the lid 25 should be made for a full understanding of the structure, manufacture and use of the lid 25.

The container 3.11 includes a second or lower lid 3.45 for being secured to the cup 3.13 about the recessed bottom 3.17 to close the recessed bottom 3.17 and to seal the portion of bread B within the recessed bottom 3.17 as will hereinafter become apparent. The lid 3.45 may include a tab portion 3.47 for allowing easy manual removal of the lid 3.45 from the cup 3.13. The lid 3.45 may be various specific sizes and shapes to correspond with the recessed bottom 3.17 of the cup 3.13 as will now be apparent to those skilled in the art and is preferably constructed of a disposable material such as by being molded out of plastic or the like as will now be apparent to those skilled in the art. The lid 3.45 may be secured to the cup 3.13 in any manner now apparent to those skilled in the art such as by being glued (not shown) or heat sealed to the bottom rim of the cup 3.13 about the recessed bottom 3.17.

The major difference between the containers 11, 2.11 and the container 3.11 is that the container 3.11 does not include a receptacle for the portion of bread B. Rather, in the container 3.11, the portion of bread B is sealed in the recessed bottom 3.17 of the cup 3.13 between the bottom member 3.24 of the cup 3.13 and the second or lower lid 3.45.

To produce the container 3.11, the cup 3.13 is filled with the portion of liquid L and the lid 3.25 is then secured to the cup 3.13 to seal the liquid L within the cup 3.13 and to form a sealed liquid/cup unit identical to the sealed liquid/cup unit 41 of the container 11; the portion of bread B is then placed with the recessed bottom 3.17 of the cup 3.13 and the second or lower lid 3.45 is secured to the cup 3.13 to seal the portion of bread B within the recessed bottom 3.17.

Although the present invention has been described and illustrated with respect to a preferred embodiment and a preferred use therefor, it is not to be so limited since modifications and changes can be made therein which are within the full intended scope of the invention.

I claim:

1. The combination of a portion of either wine or grape juice, a portion of bread, and an improved communion container containing said portion of either wine or grape juice and said portion of bread; wherein said improved communion container comprises:

(a) a cup containing said portion of either wine or grape juice, said cup having an upper rim for defining an open mouth;

(b) lid means releasably closing said open mouth of said cup, said lid means having a main portion with an outer periphery that matches said upper rim of said cup and having a tab attached to said outer periphery of said main portion for being pulled by the communicant to open said lid means and gain access to said portion of either wine or grape juice, said main portion of said lid means having an upper surface supporting said portion of bread;

(c) cover means releasably covering said upper surface of said main portion of said lid means and said portion of bread supported on said upper surface of said main portion of said lid means, said cover means having a main portion with an outer periphery that matches said upper rim of said cup and having a tab attached to and extending outwardly of said outer periphery of said main portion of said cover means, said lid means and said cup for being pulled by the communicant to easily open said cover means and gain access to said portion of bread, said lid means remaining intact on said mouth of said cup when said cover means is opened;

said tab of said lid means having a first position folded back over said lid means and beneath said main portion of said cover means for preventing the communicant from inadvertently pulling said tab of said lid means and opening said lid means prior to opening said cover means and receiving said portion of bread and a second position extending outward of said outer periphery of said main portion of said lid means after said cover means has been opened sufficiently to gain access to said portion of bread and expose said tab of said lid means for allowing the communicant to easily open said lid means to gain access to said portion of either wine or grape juice; and (d) attachment means releasably attaching the outer periphery of said cover means to said outer periphery of said lid means and at least a portion of said tab of said lid means such that said tab of said lid means is held folded back beneath said main portion of said cover means in said first position such that the communicant is prevented from inadvertently pulling said tab of said lid means and opening said lid means prior to opening said cover means and receiving said portion of bread such that the communicant is required to first pull said tab of said cover means to gain access to said portion of bread before being able to pull said tab of said lid means to gain access to said portion of either wine or grape juice.

2. The combination of claim 1 in which said attachment means includes adhesive means attaching said cover means to said lid means.

3. The combination of claim 1 in which said main portion of said lid means is slightly concaved so that the top of said cover means is substantially flat with said portion of bread positioned in the concavity.

* * * * *